US009809915B2

(12) United States Patent
Lee

(10) Patent No.: US 9,809,915 B2
(45) Date of Patent: Nov. 7, 2017

(54) DRUM TYPE WASHING MACHINE AND OPERATING METHOD OF THE SAME

(71) Applicant: Dongbu Daewoo Electronics Corporation, Seoul (KR)

(72) Inventor: Joon Gil Lee, Incheon (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 0 days.

(21) Appl. No.: 14/187,160

(22) Filed: Feb. 21, 2014

(65) Prior Publication Data

US 2015/0218744 A1 Aug. 6, 2015

(30) Foreign Application Priority Data

Dec. 26, 2013 (KR) ..... 10-2013-0163679

(51) Int. Cl.

| | |
|---|---|
| ***D06F 39/08*** | (2006.01) |
| ***D06F 33/02*** | (2006.01) |
| ***D06F 39/00*** | (2006.01) |
| *D06F 37/26* | (2006.01) |

(52) U.S. Cl.

CPC ..... *D06F 33/02* (2013.01); *D06F 39/004* (2013.01); *D06F 37/267* (2013.01); *D06F 39/083* (2013.01); *D06F 39/087* (2013.01); *D06F 2202/02* (2013.01); *D06F 2202/085* (2013.01); *D06F 2202/12* (2013.01); *D06F 2204/10* (2013.01)

(58) Field of Classification Search

CPC ..... D06F 33/02; D06F 39/087

See application file for complete search history.

(56) References Cited

FOREIGN PATENT DOCUMENTS

| | | | |
|---|---|---|---|
| CN | 1369592 | A | 9/2002 |
| CN | 1769574 | A | 5/2006 |
| CN | 1876936 | A | 12/2006 |
| EP | 1236824 | | 9/2002 |
| EP | 1655407 | | 5/2006 |
| EP | 1731656 | | 12/2006 |
| EP | 2458061 | | 5/2012 |
| KR | 100748977 | A | 11/2006 |
| KR | 1020090061463 | A | 6/2009 |
| KR | 1020130077996 | A | 7/2013 |

*Primary Examiner* — Jason Ko

(57) ABSTRACT

A washing machine for washing laundry may include a drum type washing machine having a tub, a drum, a water pressure and/or level sensor, an air flow path, a bubble detecting sensor, and a controller. The bubble detecting sensor may be along the air flow path of the tub in order to detect whether bubbles, suds or foam are generated within the tub and/or whether the bubbles, suds or foam exceed an acceptable amount. When the bubbles within the tub are detected and/or exceed the acceptable amount, the washing machine (e.g., the controller) may perform a preset or predetermined bubble removing course or procedure to remove or reduce the bubbles.

11 Claims, 3 Drawing Sheets

DRUM TYPE WASHING MACHINE AND OPERATING METHOD OF THE SAME

CROSS-REFERENCE TO RELATED APPLICATIONS

This application is based on and claims priority from Korean Patent Application No. 10-2013-0163679, filed on Dec. 26, 2013 with the Korean Intellectual Property Office, the disclosure of which is incorporated herein in its entirety by reference.

TECHNICAL FIELD

The present disclosure relates to a washing machine for washing laundry. The washing machine, which is an apparatus for supplying water and detergent to wash clothes or the like, is widely used in the home and in industry.

BACKGROUND

In general, a washing machine may be an upright type or pulsator type washing machine in which a drum that holds the laundry and rotates around a vertical axis, or a drum type washing machine, in which the drum rotates around a horizontal axis.

Since laundry in an upright type washing machine is generally inserted from the top, the upright type washing machine may be referred to as a top loading washing machine, and since laundry in a drum type washing machine is generally inserted from the front, the drum type washing machine may be referred to as a front loading washing machine.

The washing machine generally includes a tub for holding or accommodating water (e.g., washing water) and a drum for accommodating laundry and that rotates inside the tub.

In general, the tub is in a fixed position inside the washing machine, and the drum is mounted or installed inside the tub and configured to rotate inside the tub. The drum may have a plurality of through-holes through which water in the tub may flow in and out.

In a related art drum type washing machine, a motor may be mounted or installed below and/or behind the tub, and the drum mounted or installed inside the tub may be connected with the motor through a rotatable shaft supported by a bearing mounted or installed in the tub wall. A recent drum type washing machine can be mounted or installed on a wall (a so-called "wall mounted" washing machine), enabling installation and use of the washing machine is small or narrow spaces.

The drum type washing machine generally uses less water compared to the upright or pulsator type washing machine. However, a large amount of bubbles, suds or foam may be generated during a washing process.

The bubbles may permeate or accumulate between an external wall of the drum and an inner wall of the tub, which may cause a decrease in the rotation rate or a loss of rotation or rotational force of the drum, thereby causing a waste of energy.

SUMMARY

The present disclosure has been made in an effort to provide a drum type washing machine, and operating method thereof, which detects whether bubbles, suds and/or foam (hereinafter, "bubbles") exceed an acceptable level in order to reduce or remove the bubbles.

One or more exemplary embodiments of the present disclosure provide a drum type washing machine including a tub configured to store water and having an air hole (e.g., that enables gaseous and/or fluid communication between an inside and an outside of the tub).

The drum may be mounted or installed inside the tub to provide a space in which laundry is placed and washed.

A rotation shaft of the drum may be supported by a bearing installed on a rear wall (e.g., a rear wall surface) of the tub. The rotation shaft may extend outside of the rear wall where it may be connected with a motor.

The washing machine may include a water pressure and/or level sensor for sensing a level or pressure of water in the tub. A drainage port for draining water may be at a lower side of the tub, and the water pressure and/or level sensor may be in a discharge flow path of or from the drainage port.

The tub may include an air hole permitting air permeability (e.g., between the inside and outside of the tub). The air hole may be formed in the rear wall of the tub. The washing machine may include an air flow path connected with or to the air hole.

In order to detect whether and/or to what extent bubbles, suds or foam are generated within the tub, a bubble detecting sensor may be in or along the air flow path connected with or to the air hole of the tub.

When bubbles are not excessively generated during a washing process, the generation of the bubbles is not a problem. Accordingly, it may be necessary to distinguish and detect when the bubbles are at a level causing a problem and when the bubbles are at an allowable level, and for this reason, a position of the bubble detecting sensor may be important.

The air hole may be above the rotation shaft of the drum, and the bubble detecting sensor may be in the air flow path connected with or to the air hole. Accordingly, when bubbles are generated within the tub to a level at which they are discharged through the air hole, the bubbles may be detected by the bubble detecting sensor. The air hole may be in the rear wall of the tub, above the rotation shaft of the drum.

When the bubble detecting sensor detects that bubbles are generated (or exceed an acceptable amount), a controller may instruct or control the washing machine to perform a bubble removing course or procedure for reducing or removing bubbles, suds or foam.

The controller may determine whether to perform the bubble removing procedure by further considering a measurement, indication, or result of the water pressure and/or level sensor.

The controller may initiate (and control) the bubble removing procedure when a water pressure and/or water level measured or indicated by the water pressure and/or level sensor is equal to or greater than a set value, and the bubbles are detected by the bubble detecting sensor. When the water pressure and/or level is equal to or greater than the set value, the controller may instruct the bubble detecting sensor to monitor or detect the bubbles. For example, once the water pressure and/or level is equal to or greater than the set value, the controller may apply (or supply) power to (e.g., activate) the bubble detecting sensor, thereby increasing sensing efficiency.

The bubble detecting sensor may include a bubble sensing chamber having a larger cross-sectional area than the air flow path.

Water inside the tub may be discharged through the air flow path, thereby causing an erroneous detection of bubbles. The problem of erroneous bubble detection may be solved by providing a bubble sensing chamber having a larger cross-sectional area than the air flow path. For example, water discharged through the air hole generally flows to the floor of the bubble sensing chamber. As a result, the erroneous detection caused by the water may be avoided or prevented.

The bubble detecting sensor may include a first terminal and a second terminal, each of which has one end exposed inside the bubble sensing chamber. Electricity may be conducted between the first terminal and the second terminal by the bubbles, so that it is possible to determine whether bubbles (or an excessive amount thereof) are generated.

A distal end of at least one of the first terminal and the second terminal may be higher than an outlet of the bubble sensing chamber. Water flowing into the bubble sensing chamber may thus be directly discharged without the conduction of the electricity between the first and second terminals, so that it is possible to more accurately detect the bubbles.

The bubble detecting sensor may include a first terminal block for affixing the first terminal to the bubble sensing chamber while supporting (e.g., structurally supporting) the first terminal, and a second terminal block for affixing the second terminal to the bubble sensing chamber while supporting (e.g., structurally supporting) the second terminal.

In the first and second terminals, a part (e.g., a wire) exposed to the outside of the bubble sensing chamber may be connected to the controller through a sensor circuit. Electricity conducted between the first terminal and the second terminal within the bubble sensing chamber may cause the sensor circuit to transmit a signal to the controller.

According to exemplary embodiments of the present disclosure, when a large amount of bubbles are generated (e.g., at or approaching a level causing a problem), the washing machine detects the bubbles and performs a procedure for removing or reducing the bubbles.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented.

A washing machine according to one or more exemplary embodiments of the present disclosure may be a drum type washing machine in which a drum (not illustrated) is horizontally mounted or installed and rotates inside a tub 10.

The general concept of a drum type washing machine is well known in the art. Therefore, description(s) of part(s) irrelevant to the present disclosure may generally be omitted, and only part(s) relevant to the present disclosure may be described.

Figure 1:
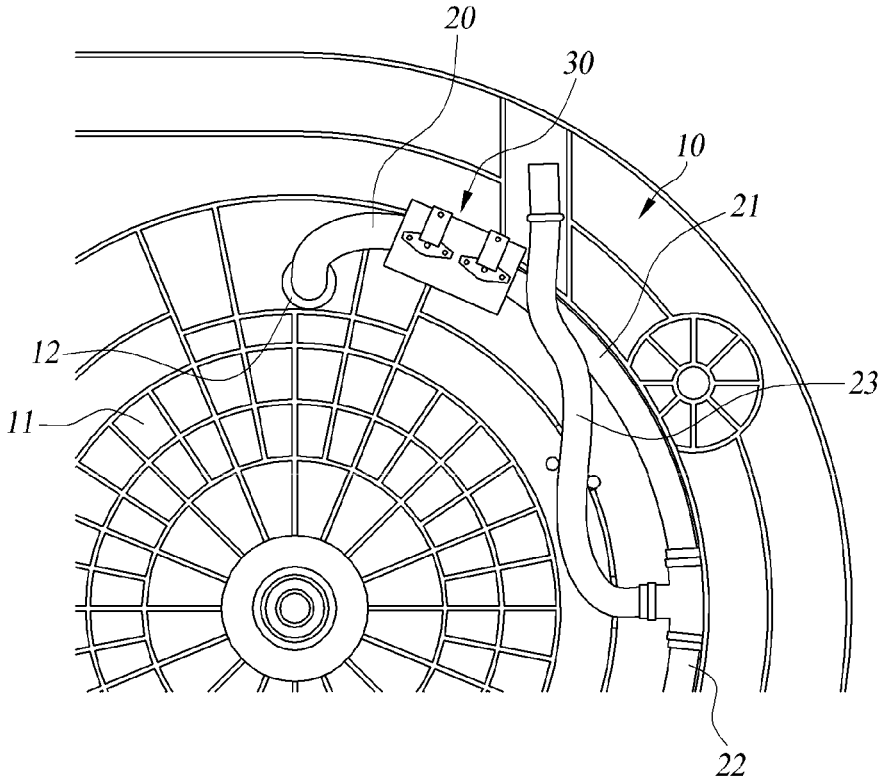
FIG. 1 is a diagram illustrating a rear wall of a tub of a drum type washing machine according to one or more exemplary embodiments of the present disclosure.

FIG. 1 illustrates a rear wall 11 of a tub 10 of an exemplary drum type washing machine according to an exemplary embodiments of the present disclosure.

A bearing may be installed at a center of the rear wall 11 of the tub 10 in order to support a rotation shaft connected with the drum.

An air hole 12 may be formed in or at an upper portion of the rear wall 11 of the tub 10. A first hose 20 may be connected to air hole 12 and a second hose 21. The second hose 21 may branch into a third hose 22 and a fourth hose 23.

The third hose 22 may guide water discharged through the first hose 20 along a discharge flow path. The fourth hose 23 may enable gaseous and/or fluid communication between the inside and outside of tub 10 together with first hose 20 and second hose 21, so that air inside and outside tub 10 may flow into or be discharged from the tub 10.

Air permeability within tub 10 may be secured or provided through air hole 12 and first, second and fourth hoses 20, 21 and 23. When the inside of tub 10 is sealed, negative pressure may be applied to the inside of tub 10 when a user attempts to open a door of the washing machine, thereby preventing the door from being opened. Air hole 12 may therefore assist in preventing the door from being opened.

The inside and outside of tub 10 may also be ventilated by air hole 12, which may be helpful to remove odor from inside tub 10.

A bubble detecting sensor 30 may be installed in or along an air flow path connected with the air hole 12.

The bubble detecting sensor 30 may include a bubble sensing chamber 39 connected between the first hose 20 and the second hose 21. The bubbles and/or water inside the tub 10 may flow into the bubble sensing chamber 39 through the first hose 20 and may be discharged from the bubble sensing chamber 39 through the second hose 21.

The bubble sensing chamber 39 may have a larger cross-sectional area than the first hose 20 and/or the second hose 21. The bubble sensing chamber 39 may be formed and/or positioned such that water flowing in from the first hose 20 is emptied (e.g., widely spread) onto the floor or gravitational bottom of the bubble sensing chamber 39.

Figure 2:
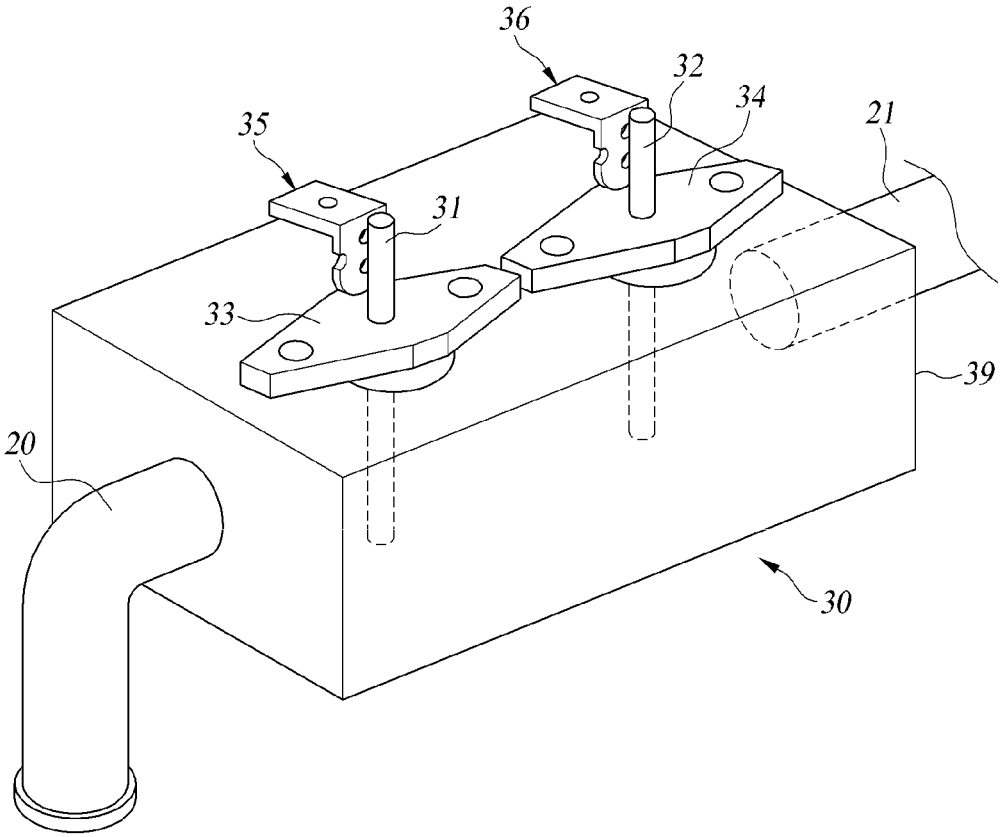
FIG. 2 is a diagram illustrating an exemplary bubble detecting sensor suitable for the washing machine of FIG. 1.

As illustrated in FIG. 2, the bubble detecting sensor 30 may include a first electrode 31 and a second electrode 32. First and second electrodes 31, 32 may each comprise an electrode and/or have a rod-like or cylindrical shape, and one end of each of the first electrode 31 and the second electrode 32 may be exposed inside the bubble sensing chamber 39. Another end (e.g., an opposite end) of each of the first electrode 31 and the second electrode 32 may be outside (e.g., exposed to the outside) of the bubble sensing chamber 39, so that the first electrode 31 and the second electrode 32 can be electrically connected with a sensor circuit (not illustrated) through a first terminal 35 and a second terminal 36.

At least one of the distal end of the first electrode 31 and the distal end of the second electrode 32 (e.g., the end[s] exposed inside the bubble sensing chamber 39) may be positioned higher than part or all of an inlet and/or outlet of the bubble sensing chamber 39. Accordingly, water may flow into the bubble sensing chamber 39 such that electricity is not conducted between the first electrode 31 and the second electrode 32 by the water, thereby preventing erroneous detection of bubbles. Bubbles that flow into the bubble sensing chamber 39 may easily reach a height equal to or greater than the outlet, thereby causing electricity to be conducted between the first and second electrodes 31, 32.

The sensor circuit may include a PCB substrate and the like. An electrical signal may be generated by the conduction of electricity between the first and second electrodes 31, 32, and transmitted to a controller by the sensor circuit.

The first electrode 31 may be supported by a first electrode block 33 and fixed to a wall (e.g., at an upper side) of the bubble sensing chamber 39, and the second electrode 32 may be supported by a second electrode block 33 and fixed to a wall (e.g., at the upper side) of the bubble sensing chamber 39. The washing machine of the present exemplary embodiments may include a water pressure and/or level sensor (not illustrated) configured to sense a water pressure and/or level of the tub 10.

The water pressure and/or level sensor may be mounted or installed in or along the discharge flow path, and is generally well-known in the art. A detailed description thereof will be omitted.

The controller may be connected to the sensor and/or may receive a measurement or indication of a water pressure and/or level from the water pressure and/or level sensor.

A washing cycle, a rinsing cycle, and a spin-drying cycle of the drum type washing machine may be programmed and input into the controller.

In order to perform each cycle, the controller may control a motor for driving the drum, a water supply valve, a drain valve and/or pump, and the like, according to the input program.

A procedure for removing or reducing bubbles may be programmed and input into the controller.

Details regarding control of the motor, the water supply valve, the drain valve and/or pump, and the like, for performing the bubble removing procedure may be identical or substantially identical to details of a bubble removing procedure in the related art, and a detailed description thereof is omitted.

In order to perform the bubble removing procedure, the controller may confirm sensing results (e.g., one or more measurements or indications) from the bubble detecting sensor 30 and the water pressure and/or level sensor.

In the present exemplary embodiment(s), when the water level and/or pressure measured by the water pressure and/or level sensor is equal to or larger than a set or predetermined value, the bubble detecting sensor 30 proceeds to detect whether bubbles are generated, and if so, the bubble removing procedure may be performed in accordance with the detection.

Figure 3:
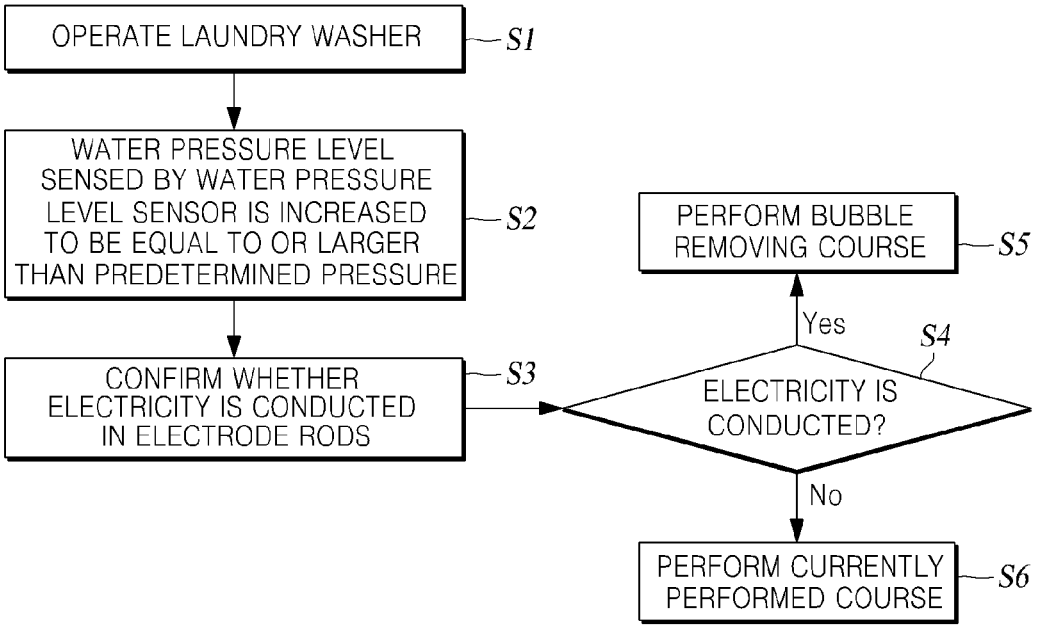
FIG. 3 is a block diagram illustrating a washing procedure, including a bubble removing or reducing procedure, using the exemplary drum type washing machine of FIG. 1.

An operating method of the bubble removing procedure will be described in more detail with reference to FIG. 3.

First, when a user inserts laundry into the drum, selects a desired washing cycle, and presses a start button, an operation (e.g., a washing cycle) of the washing machine may be started (S1).

A water pressure and/or level within the tub 10 may be sensed through the water pressure and/or level sensor during the operation of the washing machine (S2).

The controller may receive a measurement or indication from the water pressure and/or level sensor, and may determine whether the water pressure and/or level within tub 10 is equal to or larger than a predetermined pressure and/or level.

Then, when it is determined that the water pressure and/or level within tub 10 is equal to or larger than the predetermined pressure, the controller may determine whether bubbles are detected by operating (e.g., activating and operating) the bubble detecting sensor 30.

The controller may confirm whether electricity is conducted between the first electrode 31 and the second electrode 32 (S3), and when electricity is conducted, the controller determines that bubbles are detected (S4).

When bubbles are detected, the controller may initiate (and perform) the bubble removing procedure which may be input as a program in advance (S5). In such case, a cycle of the washer which is in progress at the time the bubbles are detected, may be stopped (e.g., suspended or interrupted) as a matter of course.

One exemplary bubble removing procedure may comprise removing a certain amount of the water and detergent mixture present in the tub, and adding (e.g., replacing the removed amount with) an equal amount of (detergent-free) water. The amount of liquid removed may be a specified amount (e.g., from 100 to 4000 ml, and in one case, 500 ml), then operating the bubble detecting sensor to determine whether an unacceptable amount of bubbles remain in the tub, and repeating the liquid removal and bubble detection steps until the bubble detecting sensor no longer detects (excess) bubbles. Alternatively, an amount of liquid sufficient for the bubble detecting sensor to no longer detect bubbles can be removed from the washing machine. The amount of water to be added can be the same as the specified amount removed, or the amount of water to be added can be determined using the water pressure and/or level sensor. Alternatively, the contents of a small reservoir of a concentrated saline solution (e.g., salt water) can be added (e.g., 1-2 ml at a time) until the bubbles or foam are suppressed.

After the bubble removing procedure, the cycle which had been stopped due to the bubble removing procedure, may be resumed, or the stopped cycle may be considered ended when entering (or starting) the bubble removing procedure, so that a next cycle may be performed.

When electricity is not conducted between the first electrode 31 and the second electrode 32, the controller may determine that bubbles are not detected, and a cycle of the washer which is in progress may continue (e.g., may remain uninterrupted) (S6).

When a measurement or indication of water pressure and/or water level by the water pressure and/or level sensor is equal to or lower than (or simply lower than) the set value, the detection of the bubbles is generally not performed, and a cycle of the washing machine which is in progress may continue (e.g., may remain uninterrupted).

Sensing (e.g., measuring) by the water pressure and/or level sensor and/or the bubble detecting sensor 30 may be periodically performed during the washing cycle and/or rinsing cycle.

In another aspect of the invention, a value (e.g., the power applied to or the rotation rate of the motor may be checked, inspected, or monitored to determine whether the value is equal to or greater than (or less than, or less than or equal to) a set value, thereby indicating the existence of bubbles (e.g., beyond an acceptable amount), which may then be confirmed by the water pressure and/or level sensor and the bubble detecting sensor 30. When bubbles exceed an allowable level or amount, power for driving the drum may exceed an allowable level and/or the rotation rate of the drum (based on the rotation rate of the motor) may be less than a predetermined value, and thus it may be possible to determine whether to operate the bubble detecting sensor 30 by checking and/or confirming a power or rate value of the motor.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A drum type washing machine, comprising:

a tub having an air hole permitting fluid communication between an inside of the tub and an outside of the tub, the tub configured to hold water;

a drum inside the tub, the drum configured to accommodate laundry and rotate;

a water pressure and/or level sensor configured to sense a level and/or pressure of water in the tub;

an air flow path connected with the air hole of the tub and configured to permit fluid communication between the inside of the tub and the outside of the tub;

a bubble detecting sensor along the air flow path, the bubble detecting sensor configured to detect bubbles, suds or foam, wherein the bubble detecting sensor comprises a bubble sensing chamber installed along the air flow path between a first hose and a second hose, wherein the first hose is connected to the air hole and the second hose is configured to guide water discharged through the first hose along a discharge flow path, wherein the bubble sensing chamber is configured to collect water and/or bubbles discharged from the first hose; and a controller configured to perform a bubble removing procedure according to an indication of the bubble detecting sensor, wherein the air hole is formed at an upper portion of a rear wall of the tub, wherein the second hose branches into a third hose and a fourth hose, wherein the third hose guides water discharged through the first hose along a discharge flow path and the fourth hose discharges gaseous and/or fluid from the inside of the tub and the outside of the tub, wherein the first hose, the second hose and the third hose are installed along the circumference of the rear wall, wherein the fourth hose is installed toward the upper portion of the rear wall.

2. The washing machine of claim 1, wherein the bubble detecting sensor includes a first electrode and a second electrode, each of which has one end exposed inside the bubble sensing chamber, and an opposite end outside of the bubble sensing chamber, the first and second electrodes electrically connected with the controller.

3. The washing machine of claim 2, wherein the bubble detecting sensor includes a first electrode block configured to support the first electrode and affix the first electrode to the bubble sensing chamber, and a second electrode block configured to support the second electrode and affix the second electrode to the bubble sensing chamber.

4. The washing machine of claim 1, wherein the controller is configured to perform the bubble removing procedure according to both an indication of the bubble detecting sensor and an indication of the water pressure and/or level sensor.

5. The washing machine of claim 4, wherein the controller activates the bubble detecting sensor when the indication of the water pressure and/or level sensor is equal to or greater than a set value.

6. The washing machine of claim 4, wherein the controller performs the bubble removing procedure when the indication of the water pressure sensor is equal to or greater than the set value, and the indication of the bubble detecting sensor indicates a presence of bubbles, suds or foam.

7. The washing machine of claim 6, wherein when the controller performs the bubble removing procedure, the controller terminates or concludes a cycle in progress.

8. The washing machine of claim 6, wherein when the controller performs the bubble removing procedure, the controller suspends a cycle in progress.

9. The washing machine of claim 8, wherein when the controller completes the bubble removing procedure, the controller resumes the suspended cycle.

10. The washing machine of claim 4, wherein the controller continues to perform a cycle in progress when the indication of the water pressure and/or level sensor is equal to or greater than the set value, and the indication of the bubble detecting sensor indicates an absence of bubbles, suds or foam.

11. The washing machine of claim 1, wherein the bubble sensing chamber has a larger cross-sectional area than a cross-sectional area of the air flow path.

* * * * *